United States Patent [19]

Wakabayashi et al.

[11] Patent Number: 5,027,983

[45] Date of Patent: Jul. 2, 1991

[54] APPARATUS FOR FILLING SPECIFIED AMOUNT OF LIQUID

[75] Inventors: Shigeru Wakabayashi; Yoshihiro Saijo; Yoshitaka Yamane; Yasuji Fujikawa, all of Tokushima, Japan

[73] Assignee: Shikoku Kakoki Co., Ltd., Tokushima, Japan

[21] Appl. No.: 490,242

[22] Filed: Mar. 8, 1990

[30] Foreign Application Priority Data

Mar. 24, 1989 [JP] Japan ..... 1-33488[U]

[51] Int. Cl.[5] ..... B65D 88/54

[52] U.S. Cl. ..... 222/309; 222/497; 137/542; 141/258; 239/533.1; 239/570; 239/574

[58] Field of Search ..... 222/309, 495–497, 222/504, 510, 571, 545; 239/533.1, 533.15, 574, 570; 137/542; 141/147, 261, 258

[56] References Cited

U.S. PATENT DOCUMENTS 2,030,143 2/1936 Giger-Knusli ..... 222/497 X
4,648,421 3/1987 Chant et al. ..... 222/496 X
4,925,069 5/1990 Ueda et al. ..... 222/510 X

FOREIGN PATENT DOCUMENTS 2803189 12/1978 Fed. Rep. of Germany ..... 239/574
64-45203 2/1989 Japan ..... 222/309
64-45204 2/1989 Japan ..... 222/309

*Primary Examiner*—Michael S. Huppert
*Assistant Examiner*—Gregory L. Huson
*Attorney, Agent, or Firm*—Armstrong, Nikaido, Marmelstein, Kubovcik, & Murray

[57] ABSTRACT

An apparatus for filling a specified amount of liquid comprises a vertical tubular nozzle having a large-diameter portion intermediately of its height and a valve seat at the edge of an open lower end thereof, a valve upwardly and downwardly movably supported by the filling nozzle and comprising a plug intimately fittable to the valve seat and a stem extending upward from the plug inside the nozzle, a resistance member fixed to the valve stem so as to be positioned in the large-diameter portion for acting against a downward flow of liquid, a spring biasing the valve upward to hold the plug in intimate contact with the valve seat against the gravity on the liquid within the nozzle, a metering cylinder for intermittently feeding the liquid into the nozzle in the specified amount at a time so that the valve is opened by the pressure of flow of the liquid against the spring, and the spring closing the valve when the feed of liquid is discontinued. The large-diameter portion has a diameter gradually increasing as it extends from its upper end downward.

6 Claims, 3 Drawing Sheets

APPARATUS FOR FILLING SPECIFIED AMOUNT OF LIQUID

BACKGROUND OF THE INVENTION

The present invention relates to an apparatus for filling a fluid food or like liquid into containers each in a specified amount.

Conventional apparatus of the type mentioned include one which comprises a vertical tubular filling nozzle having a valve seat at the edge of an open lower end thereof, a valve upwardly and downwardly movably supported by the filling nozzle and comprising a plug intimately fittable to the valve seat and a stem extending upward from the plug inside the filling nozzle, a spring biasing the valve upward to hold the plug in intimate contact with the valve seat against the gravity acting on the liquid in the filling nozzle, and a metering cylinder for intermittently feeding the liquid into the filling nozzle in a specified amount at a time so as to open the valve by the pressure of downward flow of the liquid against the force of the spring.

If the force of the spring of the apparatus is too great, the valve is difficult to open and the nozzle therefore opens to a small degree, with the result that the liquid flows out at a high speed to entail phenomena undesirable for filling, such as scattering of the liquid. If the spring force is too small, on the other hand, the open lower end of the nozzle will not be closed completely with the valve, permitting the liquid to drip from the nozzle.

It is considerably difficult to set the force of the spring to a suitable value. Moreover, the spring force must be determined suitably in accordance with the viscosity, temperature, quality, etc. of the liquid every time a different kind of liquid is to be filled, or different filling nozzles need to be prepared for the different kinds of liquids to be filled, hence cumbersomeness.

SUMMARY OF THE INVENTION

The main object of the present invention is to provide an apparatus free of the above problems for filling a specified amount of liquid.

The apparatus of the present invention for filling a specified amount of liquid comprises a vertical tubular filling nozzle internally having an upper small-diameter portion, an intermediate large-diameter portion and a lower small-diameter portion, the upper small-diameter portion having an inlet, the large-diameter portion having a diameter gradually increasing as it extends from its upper end downward, the lower small-diameter portion having an outlet at its lower end and internally formed with a tapered valve seat at the edge defining the outlet; a valve upwardly and downwardly movably supported by the lower portion of the filling nozzle and comprising a conical plug fittable to the valve seat and a stem extending upward from the plug inside the filling nozzle, the stem having an upper end extending into the upper small-diameter portion and a downward engaging portion at its upper end; a resistance member for acting against a downward flow of liquid, the resistance member being fixed to the stem so as to be positioned at the upper end of the large-diameter portion when the plug is in intimate contact with the valve seat; a spring biasing the valve upward to hold the plug in intimate contact with the valve seat against the gravity on the liquid within the filling nozzle; a metering cylinder for intermittently feeding the liquid from the inlet into the filling nozzle in the specified amount at a time so that the pressure of flow of the liquid acts on the resistance member to lower the valve against the force of the spring; a vertical rod upwardly and downwardly movably supported by the upper portion of the filling nozzle and having at its lower end an upward engaging portion engageable with the downward engaging portion from below; and lift means for vertically moving the vertical rod between an upper limit position and a lower limit position while the feed of the liquid to be filled is discontinued, the upward engaging portion being in engagement with the downward engaging portion with the plug in intimate contact with the valve seat when the vertical rod is in the upper limit position, the lower limit position being downwardly away from the upper limit position at least by a predetermined maximum stroke length of the valve.

With the apparatus of the present invention, the resistance member is fixed to the valve stem so as to be positioned in the large-diameter portion of the filling nozzle which portion has a diameter gradually increasing from its upper end downward, so that the greater the resistance offered by the liquid to be filled owing to the viscosity, temperature, quality or the like thereof, the greater is the pressure exerted on the resistance member by the liquid flowing down to open the valve to a greater degree. Consequently, the liquid flows out from the nozzle at a low speed without splashing. This makes it possible for a single kind of filling nozzle to handle different kinds of liquids.

Moreover, the lift means moves the vertical rod upward to close the valve in cooperation with the spring. The open lower end of the nozzle can therefore be closed completely, preventing the liquid from dripping from the nozzle.

BRIEF DESCRIPTION OF THE DRAWINGS

The drawings show an embodiment of the invention.

DESCRIPTION OF THE PREFERRED EMBODIMENT

An embodiment of the present invention will be described below with reference to the drawings.

Figure 1:
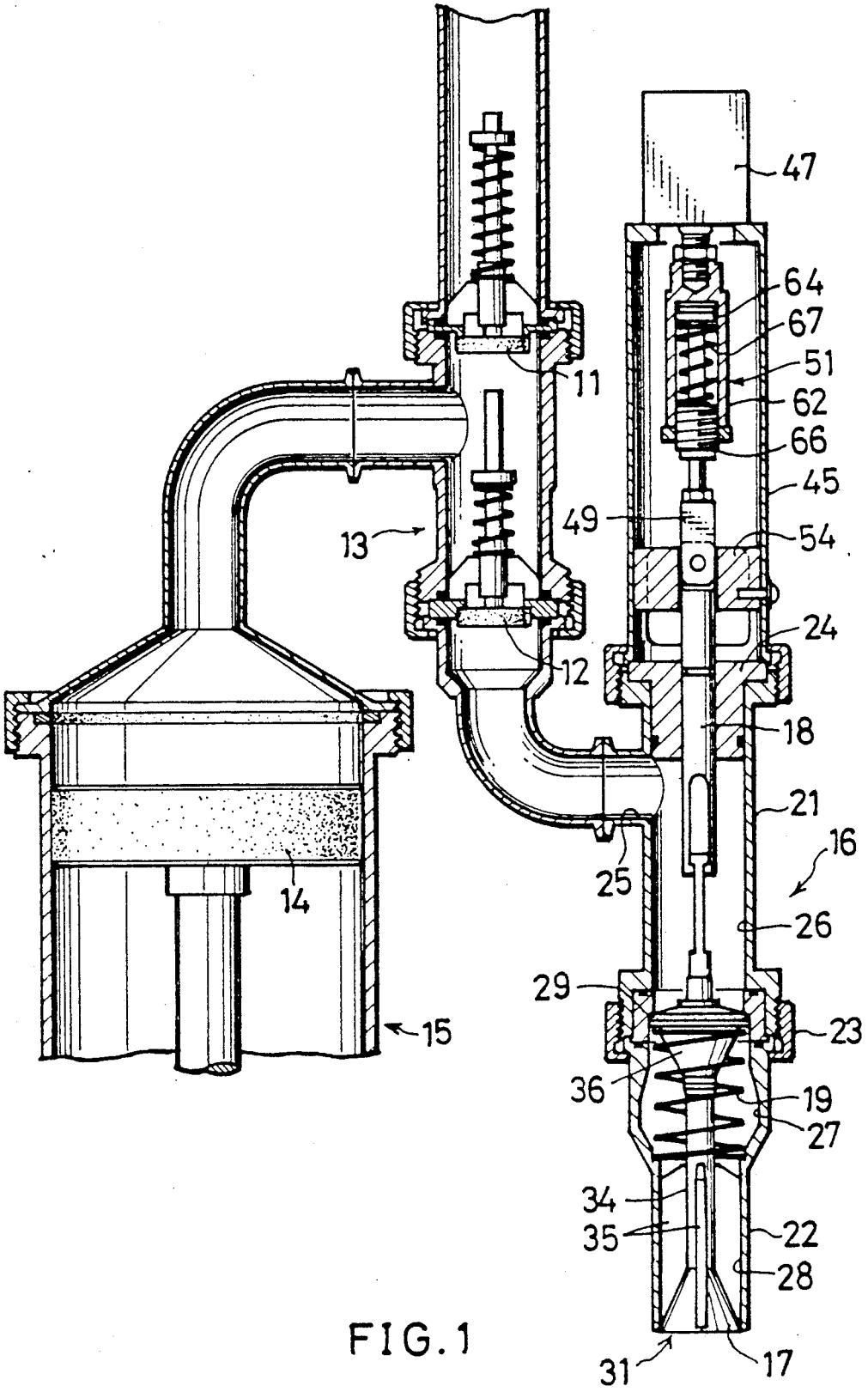
FIG. 1 is a view in vertical section.
Figure 2:
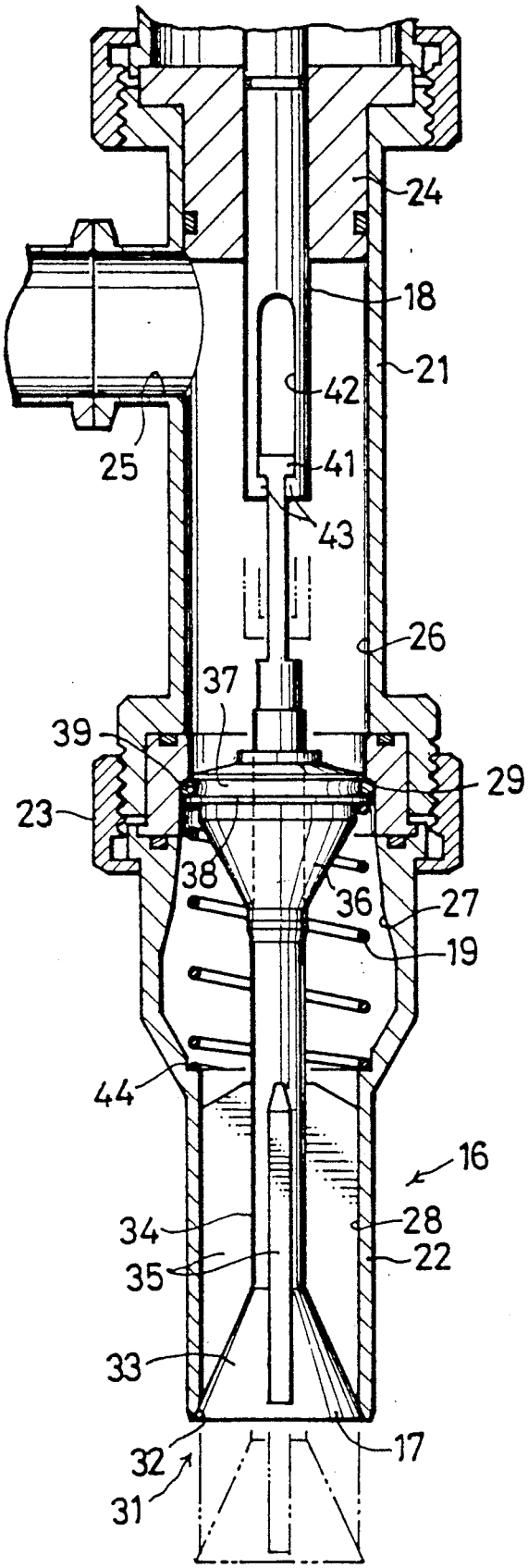
FIG. 2 is an enlarged fragmentary view in section of FIG. 1.

FIG. 1 shows a filling apparatus which comprises a vertical filling cylinder 13 having upper and lower check valves 11, 12 and connected to an unillustrated tank containing the liquid to be filled, a metering cylinder 15 connected to and communicating with the filling cylinder 13 at a portion thereof between the upper and lower check valves 11, 12 and housing a piston 14, a vertical tubular filling nozzle 16 connected to the lower end of the filling cylinder 13, a valve 17 upwardly and downwardly movably supported by the lower portion of the filling nozzle 16, a vertical rod 18 upwardly and downwardly movably supported by the upper portion of the filling nozzle 16, and a spring 19 biasing the valve 17 upward.

The filling cylinder 13 and the metering cylinder 15 are well known and will therefore not be described in detail.

Figure 3:
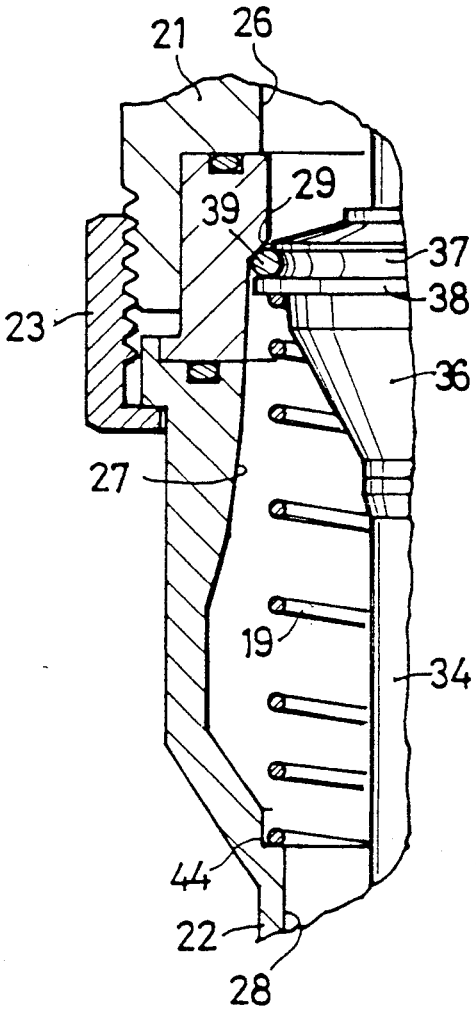
FIG. 3 is an enlarged fragmentary view in section of FIG. 2.

The filling nozzle 16 comprises an upper member 21 and a lower member 22 which are interconnected by fastening means 23. The upper end of the upper member 21 is covered with a closure 24. The upper member 21 has an inlet 25 formed in its peripheral wall at a position close to its upper end. With respect to the inside diameter, almost entire portion of the upper member 21 and the upper end portion of the lower member 22 provide an upper small-diameter portion 26, the upper portion of the lower member 22 continuous with its upper end portion provides an intermediate large-diameter portion 27, and the lower portion of the lower member 22 forms a lower small-diameter portion 28. As shown in the greatest detail in FIG. 3, the intermediate large-diameter portion 27 has a diameter gradually increasing as it extends from its upper end downward and is largest in diameter at a portion slightly below the middle of its height. A downward stepped portion 29 is formed at the boundary between the upper small-diameter portion 26 and the large diameter portion 27 to make the upper end of the large-diameter portion 27 larger than the lower end of the upper portion 26. The lower small-diameter portion 28 has an outlet 31 at its lower end and is internally formed with a tapered valve seat 32 at the edge thereof defining the outlet.

The valve 17 comprises a conical plug 33 fittable to the valve seat 32 and a stem 34 extending upward therefrom. The lower end of the plug 33 is brought into intimate contact with the valve seat 32 from below. The valve 17 has four radial blades 35 equidistantly spaced apart from one another by 90 degrees, formed over the plug 33 except at its lower end and extending to the lower portion of the stem 34. Each of the blades 35 has an outer edge slidably in contact with the inner surface of the lower small-diameter portion 28. The liquid flowing out from the outlet 31 is guided by the blades 35 so as to concentrically impinge on the corners of an unillustrated container having a square to rectangular cross section. The blades also serve the function of guiding the valve 17 for upward or downward movement.

A resistance member 36 which is to act against a downward flow of liquid is fixed to the stem 34 at a lengthwise intermediate portion thereof. The resistance member 36 is in the form of an inverted cone having an axial bore with the stem 34 extending therethrough. The resistance member 36 has an upper surface in the form of a portion of a spherical surface and is formed with an annular groove 37 immediately under the peripheral edge of the upper surface and with a flange 38 below the edge to define the groove 37. An O-ring 39 is fitted in the annular groove 37. As shown in detail in FIG. 3, the flange 38 is diametrically larger than the lower end of the upper small-diameter portion 26 and smaller than the upper end of the large-diameter portion 27. When the plug 33 is in intimate contact with the valve seat 32, the peripheral edge of upper surface of the resistance member 36 is positioned at the upper end of the large-diameter portion 27, and the O-ring 39 is positioned between the flange 38 and the stepped portion 29 at the boundary between the upper small-diameter portion 26 and the large-diameter portion 27.

The upper end of the stem 34 is positioned at the midportion of height of the upper small-diameter portion 26 and provided with a flange serving as a downward engaging portion 41.

The vertical rod 18 slidably extends through the closure 24 and has its upper end projected upward beyond the closure 24. A vertical slit 42 extends upward from the lower end of the vertical rod 18. The slit 42 has a length not smaller than a predetermined maximum stroke length of the valve 17. The downward engaging portion 41 is positioned in the slit 42. At the lower end of the vertical rod 18, inward projections opposed to each other are formed on the respective side faces defining the slit 42 to provide an upward engaging portion 43 engageable with the downward engaging portion 41 from below.

The spring 19 is provided between the flange 38 of the resistance member 36 and an upward stepped portion 44 formed at the boundary between the large-diameter portion 27 and the lower small-diameter portion 28.

Figure 4:
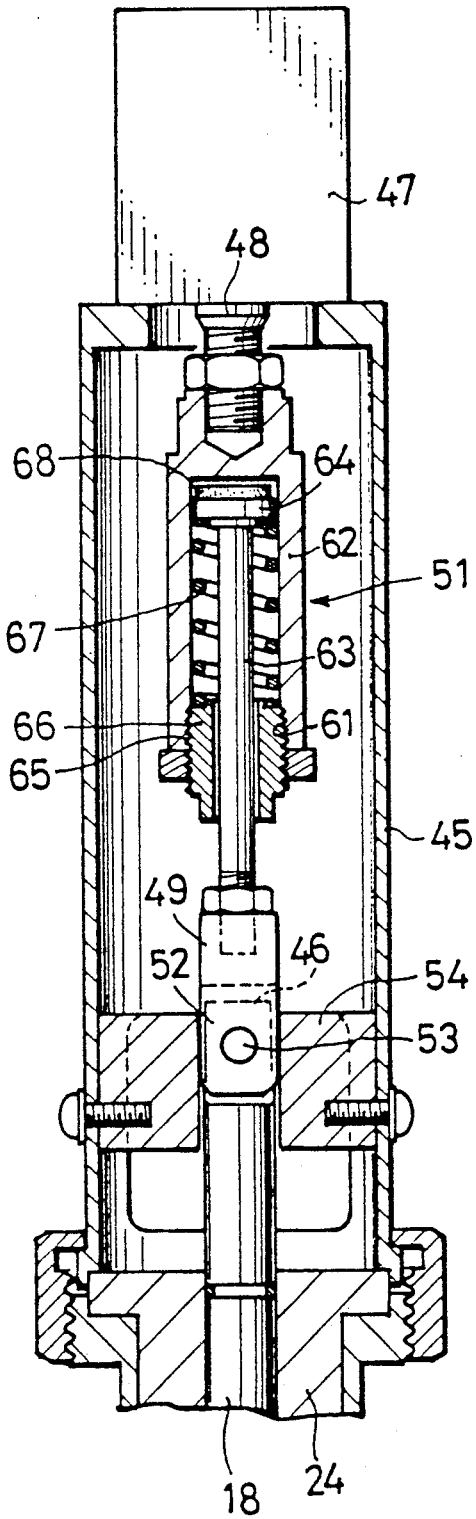
FIG. 4 is an enlarged fragmentary view in section of FIG. 1 showing a portion thereof different from that shown in FIG. 2.

As shown in detail in FIG. 4, a tubular yoke 45 is mounted on the upper end of the filling nozzle 16. The upper end of the vertical rod 18 extending into the yoke 45 has a vertical flat thin plate portion 46. A hydraulic cylinder 47 is mounted on the upper end of the yoke 45 and has a piston rod 48 extending vertically downward into the yoke 45. The upper end of the rod 18 is connected to the piston rod 48 by a connector 49 and a bumper 51. The connector 49 is generally inverted U-shaped and holds the thin plate portion 46 of the rod 18 between the opposed walls 52 thereof. A horizontal connecting pin 53 extends through the plate portion 46 and the opposed walls 52 in this state. A pair of guide members 54 opposed to each other and loosely holding the connector 49 therebetween are attached to the inner surface of the yoke 45, whereby the vertical rod 18 and the valve 17 are prevented from rotation.

The bumper 51 comprises a vertical tubular housing 62 having a closed upper end fastened to the piston rod 48 and a female screw 61 at its lower end, a center rod 63 fixed at its lower end to the connector 49 and extending upward from the connector 49 into the housing 62, a spring holder 64 provided at the upper end of the rod 63, a short tubular spring retainer 66 fitted around the center rod 63 and having an externally threaded portion 65 screwed into the female screw 61, a bumper spring 67 provided around the center rod 63 and interposed between the spring holder 64 and the retainer 66, and a rubber cushion 68 affixed to the upper face of the spring holder 64.

The drawings show the filling nozzle 16 filled with the liquid to be filled, with the valve 17 closed. In this state, the downward engaging portion 41 is in engagement with the upward engaging portion 43, and the vertical rod 18 is in the upper limit position of its vertical stroke. The piston rod 48 of the hydraulic cylinder 47 is in its retracted position, with a clearance formed between the top wall of the housing 62 and the rubber cushion 68.

The valve 17 can not be opened even if a liquid is fed from the metering cylinder 15 to the filling nozzle 16 in this state. Accordingly, before the liquid is fed from the cylinder 15 to the nozzle 16, the piston rod 48 of the hydraulic cylinder 47 is advanced to shift the vertical rod 18 from the upper limit position to the lower limit position, whereby the two engaging portions 41, 43 are released from each other, rendering the valve 17 free to descend. The liquid is then fed from the metering cylinder 15 to the filling cylinder 16, permitting a liquid pressure to act on the resistance member 36, which in turn is pushed down along with the valve 17. The amount of pushing down is dependent on the resistance offered by the resistance member 36 to the liquid when the liquid passes around the member 36 while flowing down the nozzle 16. For example, if the liquid has great viscosity and encounters great resistance, the amount of pushing down of the resistance member 36 is great, whereas if the liquid has low viscosity to encounter low resistance, the amount of pushing down of the member 36 is small. When the valve 17 is opened to a degree in accordance with the viscosity and the like of the liquid, the liquid flows out of the nozzle 16 through the outlet 31.

When the feed of the liquid from the metering cylinder 15 is discontinued to complete one cycle of filling operation, the spring 19 exerts an upward force on the valve 17. At this time or slightly before or after this time, the hydraulic cylinder 47 is actuated to raise the vertical rod 18. In the course of the upward movement, the two engaging portions 41, 43 come into engagement with each other, raising the valve 17 to bring the plug 33 into intimate contact with the valve seat 32, whereby the outlet 31 is closed. With the closing of the outlet 31, the vertical rod 18 stops rising. The housing 62 and the spring retainer 66 of the bumper 51 only are thereafter slightly moved upward along with the piston rod 48 to compress the bumper spring 67. This mitigates the impact acting on the valve 17, the vertical rod 18, etc. when the valve 17 is closed.

What is claimed is:

1. An apparatus for filling a specified amount of liquid comprising:

a vertical tubular filling nozzle internally having an upper small-diameter portion, an intermediate large-diameter portion and a lower small-diameter portion, the upper small-diameter portion having an inlet, the large-diameter portion having a diameter gradually increasing as it extends from its upper end downward, the lower small-diameter portion having an outlet at its lower end and internally formed with a tapered valve seat at the edge defining the outlet, a valve upwardly and downwardly movably supported by the lower portion of the filling nozzle and comprising a conical plug fittable to the valve seat and a stem extending upward from the plug inside the filling nozzle, the stem having an upper end extending into the upper small-diameter portion and a downward engaging portion at its upper end, a resistance member for acting against a downward flow of liquid, the resistance member being fixed to the stem so as to be positioned at the upper end of the large-diameter portion when the plug is in intimate contact with the valve seat, a spring biasing the valve upward to hold the plug in intimate contact with the valve seat against the gravity on the liquid within the filling nozzle, a metering cylinder for intermittently feeding the liquid from the inlet into the filling nozzle in the specified amount at a time so that the pressure of flow of the liquid acts on the resistance member to lower the valve against the force of the spring, a vertical rod upwardly and downwardly movably supported by the upper portion of the filling nozzle and having at its lower end an upward engaging portion engageable with the downward engaging portion from below, and lift means for vertically moving the vertical rod between an upper limit position and a lower limit position while the feed of the liquid to be filled is discontinued, the upward engaging portion being in engagement with the downward engaging portion with the plug in intimate contact with the valve seat when the vertical rod is in the upper limit position, the lower limit position being downwardly away from the upper limit position at least by a predetermined maximum stroke length of the valve.

2. An apparatus as defined in claim 1 wherein the valve has four radial blades equidistantly spaced apart from one another by 90 degrees and extending from the plug to the lower portion of the stem, each of the blades having an outer edge slidably in contact with the inner surface of the lower small-diameter portion, the valve being provided with means for preventing the rotation thereof.

3. An apparatus as defined in claim 1 wherein the lift means includes a bumper for mitigating the impact acting on the valve and the vertical rod when the plug comes into intimate contact with the valve seat.

4. An apparatus as defined in claim 1 wherein the upper small-diameter portion of the filling nozzle has a closure covering the upper end thereof, and the upper end of the vertical rod extends through the closure to project upward beyond the closure, the lift means comprising a hydraulic cylinder disposed above the vertical rod, attached to the filling nozzle by a yoke and having a vertically downward piston rod, and a bumper connecting the upper end of the vertical rod to the piston rod for mitigating the impact acting on the valve and the vertical rod when the plug comes into intimate contact with the valve seat.

5. An apparatus as defined in claim 1 wherein a downward stepped portion is formed at the boundary between the upper small-diameter portion of the filling nozzle and the large-diameter portion thereof to make the upper end of the large-diameter portion larger than the lower end of the upper small-diameter portion, and the resistance member is in the form of a circle centered about the axis of the stem when seen from above and is diametrically larger than the lower end of the upper small-diameter portion and smaller than the upper end of the large-diameter portion.

6. An apparatus as defined in claim 5 wherein an O-ring is attached to the outer periphery of the resistance member so as to be positioned between the stepped portion and the resistance member when the plug is in intimate contact with the valve seat.

* * * * *